US006083379A

United States Patent [19]

Drake et al.

[11] Patent Number: 6,083,379

[45] Date of Patent: Jul. 4, 2000

[54] PROCESS FOR DESULFURIZING AND AROMATIZING HYDROCARBONS

[75] Inventors: Charles A. Drake, Nowata; Scott Douglas Love, Bartlesville, both of Okla.

[73] Assignee: Phillips Petroleum Company, Bartlesville, Okla.

[21] Appl. No.: 09/114,991

[22] Filed: Jul. 14, 1998

[51] Int. Cl.[7] ..... C10G 35/04; C10G 25/50; C07C 15/02; C07C 2/52

[52] U.S. Cl. ..... 208/218; 208/209; 208/213; 208/62; 208/66; 208/92; 208/97; 208/134; 585/411; 585/413; 585/418

[58] Field of Search ..... 208/209, 213, 208/218, 134, 62, 97, 66, 92; 585/411, 413, 418

[56] References Cited

U.S. PATENT DOCUMENTS

| | | | |
|---|---|---|---|
| 4,190,519 | 2/1980 | Miller et al. | 208/79 |
| 4,314,901 | 2/1982 | Nowack et al. | 208/216 R |
| 4,374,046 | 2/1983 | Antos | 252/466 B |
| 5,143,596 | 9/1992 | Maxell et al. | 208/89 |
| 5,171,425 | 12/1992 | Muller | 208/208 R |
| 5,318,680 | 6/1994 | Fletcher et al. | 208/89 |
| 5,318,690 | 6/1994 | Fletcher et al. | 208/89 |
| 5,320,742 | 6/1994 | Fletcher et al. | 208/89 |
| 5,401,391 | 3/1995 | Collins et al. | 208/208 R |
| 5,409,596 | 4/1995 | Fletcher et al. | 208/89 |
| 5,482,617 | 1/1996 | Collins et al. | 208/227 |
| 5,895,828 | 4/1999 | Yao et al. | 585/418 |

OTHER PUBLICATIONS

U.S. application No. 09/114,992, Drake et al., filed Jul. 14, 1998.

*Primary Examiner*—Walter D. Griffin
*Assistant Examiner*—Tam M. Nguyen
*Attorney, Agent, or Firm*—Jeffrey R. Anderson

[57] ABSTRACT

A process for desulfurizing and enhancing the octane of cracked gasoline by first aromatizing the cracked gasoline and, second, hydrodesulfurizing the resulting intermediate product stream.

16 Claims, 3 Drawing Sheets

PROCESS FOR DESULFURIZING AND AROMATIZING HYDROCARBONS

BACKGROUND OF THE INVENTION

The present invention relates to the field of hydrocarbon upgrading processes. In another aspect, the invention relates to the desulfurization of cracked gasoline.

Hydrodesulfurization is a process primarily intended to convert the organic sulfur compounds contained in a hydrocarbon feedstream to hydrogen sulfide which is subsequently removed from the hydrocarbon feedstream.

When a petroleum fraction charged to a cracker contains sulfur, the resulting cracked gasoline also contains sulfur. The sulfur concentration in gasoline must be extremely low in order to meet environmental standards. In fact, debate is ongoing as to whether the sulfur level in gasoline should be further reduced. Thus, it is desirable to reduce the level of sulfur in gasoline to the extent possible.

In addition to meeting environmental standards for sulfur content, gasoline boiling range material, for example, naphtha, is often desulfurized prior to upgrading in an aromatization process due to concerns that the presence of sulfur will have an adverse impact on either the aromatization process or on the aromatization catalyst, or both. However, hydrodesulfurization of organic sulfur compounds contained in cracked gasoline is expected, by those skilled in the art, to result in the saturation of the unsaturated hydrocarbons, such as olefins, contained in the cracked gasoline. This is undesirable because of the resulting reduction in total octane of the cracked gasoline and because of the substantial consumption of hydrogen in saturating the olefins.

Total octane, as used herein, is defined as the flow rate, in liters/hour, of a hydrocarbon stream multiplied by the research octane number (RON) of the hydrocarbon stream. RON, as used herein, refers to the octane number of a hydrocarbon stream as determined using the ASTM D-2722 method.

Subsequent treatment of the cracked gasoline would then be required in order to recover the loss in total octane resulting from the hydrodesulfurization. Therefore, development of a process for desulfurizing cracked gasoline wherein the total octane is not reduced by the hydrodesulfurization would be a significant contribution to the art.

BRIEF SUMMARY OF THE INVENTION

It is, thus, an object of this invention to provide a process for desulfurizing cracked gasoline.

A further object of this invention is to provide a process for desulfurizing and increasing the total octane of cracked gasoline.

In accordance with the present invention, a process is provided including the steps of:

contacting a cracked gasoline feedstock with a zeolite catalyst, under reaction conditions for aromatizing hydrocarbons, to produce an intermediate product stream having an increased total octane as compared to the total octane of the cracked gasoline feedstock; and contacting the intermediate product stream with a hydrodesulfurization catalyst composition, under reaction conditions for desulfurizing sulfur containing hydrocarbons, to produce a desulfurized product stream having less than about 10 ppmw sulfur and at least the same total octane as the cracked gasoline feedstock.

In another embodiment, a process is provided including the steps of:

separating a cracked gasoline feedstock into a light fraction comprising at least one hydrocarbon having less than 8 carbon atoms per molecule and a heavy fraction comprising at least one hydrocarbon having more than 7 carbon atoms per molecule;

contacting the light fraction with a catalyst composition comprising a zeolite, under reaction conditions for aromatizing hydrocarbons, to produce an intermediate product stream such that the combined total octane of the heavy fraction and the intermediate product stream exceeds the total octane of the cracked gasoline feedstock;

separating the intermediate product stream into an overhead stream comprising a light olefin and a bottoms stream comprising an aromatic; and contacting at least a portion of the bottoms stream and at least a portion of the heavy fraction with a hydrodesulfurization catalyst composition, under reaction conditions for desulfurizing sulfur containing hydrocarbons, to produce a desulfurized product stream having less than about 10 ppmw sulfur such that the combined total octane of the remaining portion of the bottoms stream, the remaining portion of the heavy fraction, the overhead stream, and the desulfurized product stream is at least the same as the total octane of the cracked gasoline feedstock.

In yet another embodiment, a process is provided including the steps of:

separating a cracked gasoline feedstock into a light fraction comprising at least one hydrocarbon having less than 8 carbon atoms per molecule and a heavy fraction comprising at least one hydrocarbon having more than 7 carbon atoms per molecule;

contacting the light fraction with a catalyst composition comprising a zeolite, under reaction conditions for aromatizing hydrocarbons, to produce an intermediate product stream such that the combined total octane of the heavy fraction and the intermediate product stream exceeds the total octane of the cracked gasoline feedstock;

separating the intermediate product stream into an overhead stream comprising a light olefin and a bottoms stream comprising an aromatic;

separating the bottoms stream into a $C_8^-$ stream and a $C_9^+$ stream, the $C_8^-$ stream comprising benzene, toluene and xylene; and contacting at least a portion of the $C_9^+$ stream and at least a portion of the heavy fraction with a hydrodesulfurization catalyst composition, under reaction conditions for desulfurizing sulfur containing hydrocarbons, to produce a desulfurized product stream having less than about 10 ppmw sulfur such that the combined total octane of the remaining portion of the heavy fraction, the remaining portion of the $C_9^+$ stream, the overhead stream, the $C_8^-$ stream, and the desulfurized product stream is at least the same as the total octane of the cracked gasoline feedstock.

Other objects and advantages will become apparent from the detailed description and the appended claims.

DETAILED DESCRIPTION OF THE INVENTION

Figure 1:
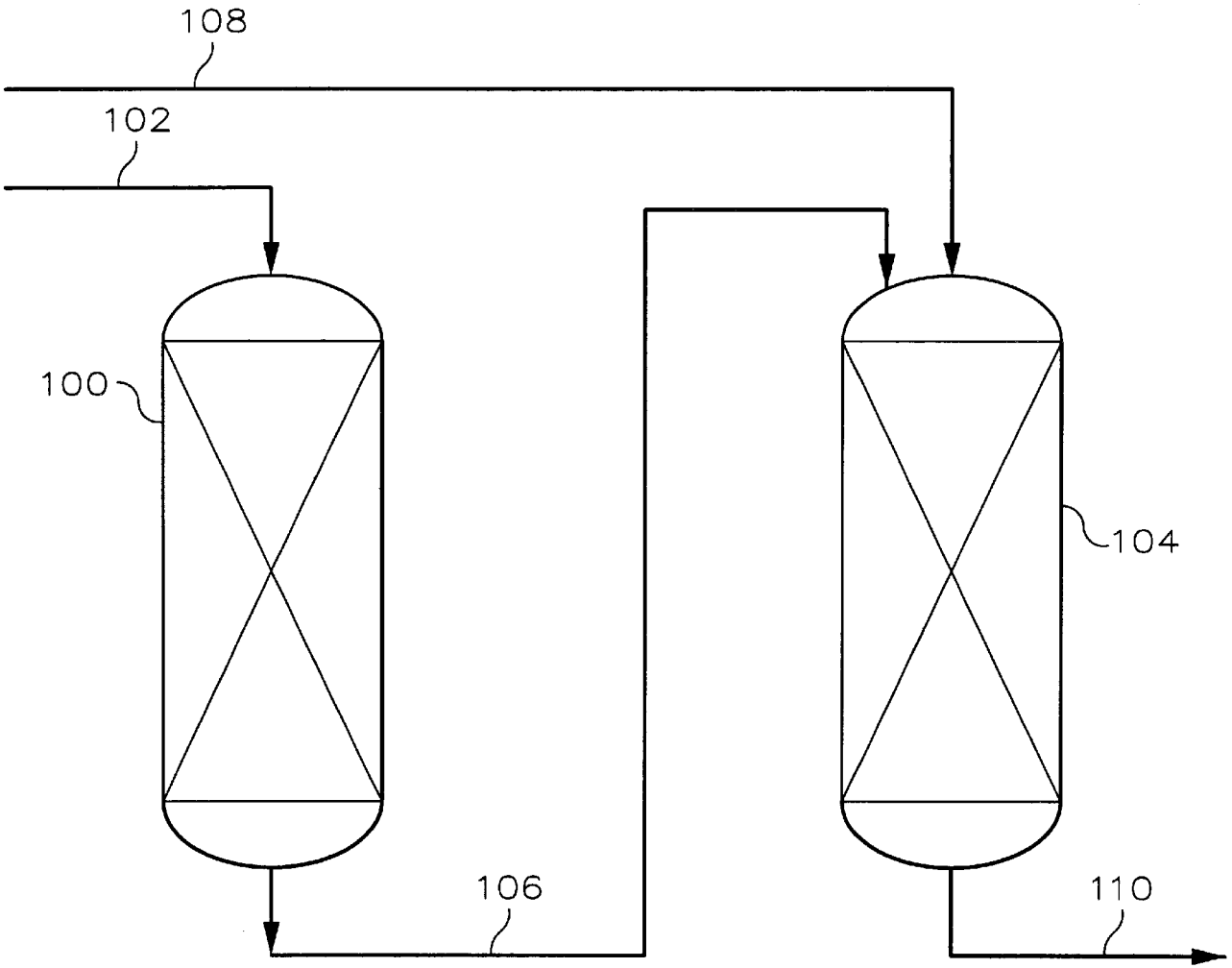
FIG. 1 is a schematic flow diagram presenting an embodiment of the present invention.

An important aspect of the inventive desulfurization process is the use of cracked gasoline as a feedstock.

The cracked gasoline feedstock can comprise paraffins and/or olefins and/or naphthenes and/or aromatics, wherein each of these hydrocarbons contains at least 5 carbon atoms per molecule. The cracked gasoline feedstock further comprises at least about 20 ppmw sulfur. More typically, the concentration of sulfur will be in the range of from about 100 ppmw to about 3000 ppmw; and most typically the sulfur content will be in the range of 200 to 1000 ppmw. Sulfur ppmw, as used herein, means the parts per million by weight of atomic sulfur contained in a hydrocarbon stream.

Non-limiting examples of suitable cracked gasoline feedstocks include gasolines from catalytic oil cracking (e.g., FCC and hydrocracking) processes, pyrolysis gasolines from thermal hydrocarbon (e.g., ethane, propane and naphtha) cracking processes, coker naphtha, light coker naphtha and the like. The preferred feed for the inventive process is a gasoline boiling range feedstock suitable for use as at least a gasoline blend stock generally having a boiling range of from about 30° C. to about 210° C. The most preferred feed is a cracked gasoline necessarily containing saturates and non-saturates.

The cracked gasoline feedstock can be aromatized by contacting the cracked gasoline feedstock, by any suitable manner, with a catalyst composition comprising a zeolite contained within a reaction zone to produce an intermediate product stream.

The aromatization step is preferably carried out under reaction conditions such that the intermediate product stream has an increased total octane as compared to the total octane of the cracked gasoline feedstock.

The aromatization step can be operated as a batch process step or, preferably, as a continuous process step. In the latter operation, a solid catalyst bed or a moving catalyst bed or a fluidized catalyst bed can be employed. Any of these operational modes have advantages and disadvantages, and those skilled in the art can select the one most suitable for a particular feed and catalyst.

The reaction temperature is more particularly in the range of from about 400° C. to about 800° C., preferably from about 450° C. to about 750° C., and most preferably from 500° C. to 700° C. The contacting pressure can range from about 0 psia to about 500 psia, preferably from about 15 psia to about 450 psia, and most preferably from 20 psia to 400 psia.

The flow rate at which the cracked gasoline feedstock is charged to the aromatization reaction zone is such as to provide a weight hourly space velocity ("WHSV", defined as the pounds/hour of feed to the reaction zone divided by the total pounds of catalyst contained within the reaction zone) in the range of from about 0.01 $hr.^{-1}$ to about 1000 $hr.^{-1}$, preferably from about 0.25 $hr.^{-1}$ to about 250 $hr.^{-1}$ and most preferably from 0.5 $hr.^{-1}$ to 100 $hr.^{-1}$.

The catalyst composition useful in the present invention comprises a zeolite and further can comprise an activity promoter. The zeolite can be acid-leached. The promoter is preferably impregnated or incorporated on or into the zeolite.

The weight of the promoter in the catalyst composition can be in the range of from about 0.01 to about 10, preferably about 0.05 to about 8, and most preferably 0.1 to 5 grams per 100 grams of the composition.

The catalyst composition can also comprise a binder. The weight of the binder generally can be in the range of from about 1 to about 50, preferably about 5 to about 40, and most preferably 5 to 35 grams per 100 grams of the catalyst composition. The zeolite generally makes up the rest of the catalyst composition.

Any commercially available zeolite which can catalyze the conversion of a hydrocarbon to an aromatic compound and an olefin can be employed. Examples of suitable zeolites include, but are not limited to, those disclosed in Kirk-Othmer Encyclopedia of Chemical Technology, third edition, volume 15 (John Wiley & Sons, New York, 1991) and in W. M. Meier and D. H. Olson, "Atlas of Zeolite Structure Types," pages 138–139 (Butterworth-Heineman, Boston, Mass., 3rd ed. 1992). The presently preferred zeolites are those having medium pore sizes. ZSM-5 and similar zeolites that have been identified as having a framework topology identified as MFI are particularly preferred because of their shape selectivity.

Any promoter that can enhance the production of aromatics in an aromatization process which converts a hydrocarbon or a mixture of hydrocarbons into light olefins and aromatic hydrocarbons can be used. The term "promoter" generally refers to either metal or a metal oxide selected from Groups IA, IIA, IIIA, IVA, VA, VIA, IIB, IIIB, IVB, VB, VIB, and VIII of the CAS version of the Periodic Table of Elements, CRC Handbook of Chemistry and Physics, Boca Raton, Fla. (74th edition; 1993–1994). The term "metal" used herein refers to both "metal" and "elements" of the Periodic Table because some elements may not be considered as metals by those skilled in the art. The term "metal" also includes metal oxide. Examples of such promoters include, but are not limited to, sulfur, phosphorus, silicon, boron, tin, magnesium, germanium, zinc, titanium, zirconium, molybdenum, lanthanum, cesium, iron, cobalt, nickel, and combinations of two or more thereof. The preferred promoter is selected from the group consisting of zinc and boron. The most preferred promoter is zinc hexaborate, also known as Dizinc Hexaborate Heptahydrate ($Zn_2B_6O_{11}\cdot 7H_2O$).

Any binder known to one skilled in the art for use with a zeolite is suitable for use herein. Examples of suitable binders include, but are not limited to, clays such as for example, kaolinite, halloysite, vermiculite, chlorite, attapulgite, smectite, montmorillonite, illite, saconite, sepiolite, palygorskite, diatomaceous earth, and combinations of any two or more thereof; aluminas such as for example α-alumina and γ-alumina; silicas; alumina-silica; aluminum phosphate; aluminum chlorohydrate; and combinations of two or more thereof. Because these binders are well known to one skilled in the art, description of which is omitted herein. The presently preferred binders are alumina and silica because they are readily available.

The RON, as determined using the ASTM D-2722 method, of the produced intermediate product stream is more particularly in the range of from about 95 to about 110; preferably in the range of from about 95 to about 108; and most preferably from 100 to 105. The RON of the cracked gasoline feedstock is in the range of from about 80 to about 94; preferably in the range of from about 80 to about 92; and most preferably from 85 to 90.

The intermediate product stream further comprises at least 20 ppmw sulfur. More typically, the sulfur content will be in the range of from about 150 to about 300 ppmw; and most typically the sulfur content will be in the range from 150 to 250 ppmw.

The intermediate product stream is hydrodesulfurized by contacting the intermediate product stream by any suitable manner with a hydrodesulfurization catalyst composition in the presence of hydrogen to produce a desulfurized product stream.

The hydrodesulfurization step can be operated as a batch process step or, preferably, as a continuous process step. In the latter operation, a solid catalyst bed or a moving catalyst bed or a fluidized catalyst bed can be employed. Any of these operational modes have advantages and disadvantages, and those skilled in the art can select the one most suitable for a particular feed and catalyst.

The hydrodesulfurization catalyst composition can be any composition effective for desulfurizing sulfur containing hydrocarbon feedstocks. More particularly, the hydrodesulfurization catalyst composition can comprise alumina to which a first metal, selected from the group consisting of molybdenum and tungsten, has been added. A second metal may also be present in the composition. The preferred second metal is selected from the group consisting of iron, cobalt and nickel. Generally, both of the catalytic components are present in the hydrodesulfurization catalyst composition in the oxide form.

Preferably, the catalyst composition is presulfided, although the catalyst composition may be allowed to become sulfided during the hydrodesulfurization process. The catalyst may be presulfided by any conventional method.

Some examples of suitable hydrodesulfurization catalysts which are commercially available are set forth in Table 1.

TABLE 1

| Company | Code | % CoO | % NiO | % $MoO_3$ |
|---|---|---|---|---|
| American Cyanamid | HDS-20A | 5.0 | — | 16.2 |
| American Cyanamid | HDS-3A | — | 3.6 | 15.2 |
| American Cyanamid | HDS-3S | 2.5 | 2.5 | 15.5 |
| Nalco | Nalcomo-477 | 3.3 | — | 14.0 |
| Nalco | Nalcomo-479 | 4.4 | — | 19.0 |
| Nalco | Nalcomo-484 | 5.0 | — | 18.5 |
| Nalco | NM-502 | — | 4.0 | 14.0 |
| Nalco | NM-506 | — | 6.7 | 27.0 |
| Shell | Shell-344 | 2.9 | — | 13.6 |
| Shell | Shell-444 | 3.7 | — | 13.3 |
| Ketjen | Ketjenfine-165 | 5.0 | — | 16.0 |
| Ketjen | Ketjenfine-153-S | — | 3.0 | 15.0 |
| United Catalysts | Co-Mo | 3.4 | — | 13–15 |
| United Catalysts | Ni-Mo | — | 3.4 | 13–15 |
| Harshaw | HT-400E | 2.7 | — | 13.7 |

The hydrodesulfurization step is preferably carried out under reaction conditions effective for reducing the sulfur content of sulfur containing hydrocarbons. The reaction temperature is more particularly in the range of from about 250° C. to about 1000° C.; preferably from about 400° C. to about 800° C.; and most preferably from 450° C. to 750° C. The contacting pressure can range from about 0 psia to about 1000 psia, preferably from about 15 psia to about 500 psia, and most preferably from 20 psia to 400 psia. The WHSV can be in the range of from about 0.01 $hr.^{-1}$ to about 1000 $hr.^{-1}$, preferably from about 0.25 $hr.^{-1}$ to about 250 $hr.^{-1}$, and most preferably from 0.5 $hr.^{-1}$ to 100 $hr.^{-1}$. The hydrogen to hydrocarbon ratio can be in the range of from about 10 to about 5000 standard cubic feet of hydrogen per barrel of hydrocarbon, preferably from about 20 to about 2500, and most preferably from 100 to 1000.

The desulfurized product stream produced by the hydrodesulfurization step comprises less than about 10 ppmw sulfur. Preferably, the sulfur content of the desulfurized product stream is less than about 8 ppmw; and most preferably less than 5 ppmw.

The RON of the $C_5$+ portion of the desulfurized product stream will be in the range of from about 95 to about 110; preferably in the range of from about 95 to about 108; and most preferably from 100 to 105.

The prior art suggests that desulfurizing a gasoline stream can result in a lowering of the RON due to the saturation of unsaturated hydrocarbons. Thus, it is unexpected that the RON of the desulfurized product stream produced by the hydrodesulfurization step is about the same as the RON of the intermediate product stream.

In another embodiment, the cracked gasoline feedstock can be separated into a light fraction comprising at least one hydrocarbon having less than 8 carbon atoms per molecule and a heavy fraction comprising at least one hydrocarbon having more than 7 carbon atoms per molecule. Preferably, the light fraction comprises hydrocarbons having from 5 to 7 carbon atoms per molecule, and most preferably, the light fraction comprises $C_5$–$C_7$ olefins in the range of from about 40 weight % to about 60 weight % of the light fraction.

The light fraction further comprises at least about 20 ppmw sulfur. More typically, the concentration of sulfur will be in the range of from about 100 ppmw to about 3000 ppmw; and most typically the sulfur content will be in the range of from 200 to 1000 ppmw.

The light fraction can then be aromatized by contacting the light fraction, by any suitable manner, with the catalyst composition, described above, contained within a reaction zone to produce an intermediate product stream.

The aromatization step is preferably carried out under reaction conditions such that the combined total octane of the heavy fraction and the intermediate product stream exceeds the total octane of the cracked gasoline feedstock.

The aromatization step can be operated as a batch process step or, preferably, as a continuous process step, as described above, and under reaction conditions as described above.

The flow rate at which the light fraction is charged to the aromatization reaction zone is such as to provide a WHSV in the range of from about 0.01 $hr.^{-1}$ to about 1000 $hr.^{-1}$, preferably from about 0.25 $hr.^{-1}$ to about 250 $hr.^{-1}$ and most preferably from 0.5 $hr^{-1}$ to 100 $hr.^{-1}$.

The RON of the $C_5$+ portion of the intermediate product stream is more particularly in the range of from about 90 to about 105; preferably in the range of from about 90 to about 103; and most preferably from 95 to 100. The RON of the light fraction is in the range of from about 80 to about 94; preferably in the range of from about 80 to about 90; and most preferably from 85 to 90.

The intermediate product stream further comprises at least 20 ppmw sulfur. More typically, the sulfur content will be in the range of from about 150 to about 300 ppmw; and most typically the sulfur content will be in the range of from 150 to 250 ppmw.

The intermediate product stream can be separated into an overhead stream comprising hydrocarbons having less than 5 carbon atoms per molecule and a bottoms stream comprising hydrocarbons having more than 4 carbon atoms per molecule.

The bottoms stream preferably comprises benzene, toluene and xylene (BTX) and heavier aromatics. The overhead stream preferably comprises ethylene, propylene and butylenes.

The overhead stream can be further processed downstream to produce valuable light olefins such as ethylene, propylene and butylenes. The removal of the light olefins from the intermediate product stream, prior to contact with the hydrodesulfurization catalyst composition, avoids the hydrogenation of these olefins to lower value paraffins and provides a yield of light olefins. Also, less hydrogen will be consumed in the hydrodesulfurization reactor due to the absence of the light olefins, improving the efficiency of the reactor.

At least a portion of the bottoms stream and at least a portion of the heavy fraction described above can be hydrodesulfurized by contact, in any suitable manner, with a hydrodesulfurization catalyst composition, as described above, in the presence of hydrogen thereby producing a desulfurized product stream.

The hydrodesulfurization step can be operated as a batch process step, or, preferably as a continuous process step, as described above, and under reaction conditions as described above.

The desulfurized product stream produced by the hydrodesulfurization step comprises less than about 10 ppmw sulfur. Preferably, the sulfur content of the desulfurized product stream is less than about 8 ppmw; and most preferably less than 5 ppmw.

The RON of the desulfurized product stream will be in the range of from about 95 to about 110; preferably in the range of from about 95 to about 108; and most preferably from 100 to 105.

In another embodiment, the bottoms stream described above can be separated into a $C_8^-$ stream comprising hydrocarbons having less than 9 carbon atoms per molecule and a $C_9^+$ stream comprising hydrocarbons having more than 8 carbon atoms per molecule.

The $C_9^+$ stream preferably comprises aromatics with more than 8 carbon atoms per molecule and at least 20 ppmw sulfur. More typically, the sulfur content will be in the range of from about 150 to about 300 ppmw; and most typically the sulfur content will be in the range of from 150 to 250 ppmw. The $C_8^-$ stream preferably comprises BTX.

The $C_8^-$ stream can be further processed downstream to produce valuable benzene, toluene and xylene products. The removal of the BTX from the bottoms stream prior to contact with a hydrodesulfurization catalyst composition, as described above, avoids the possibility of hydrogenating these aromatics to lower octane cycloparaffins and provides a yield of BTX.

At least a portion of the $C_9^+$ stream and at least a portion of the heavy fraction described above can be hydrodesulfurized by contact, in any suitable manner, with a hydrodesulfurization catalyst composition in the presence of hydrogen to produce a desulfurized product stream.

The hydrodesulfurization step can be operated as a batch process step or, preferably, as a continuous process step, as described above, and under reaction conditions as described above.

The desulfurized product stream produced by the hydrodesulfurization process comprises less than about 10 ppmw sulfur. Preferably, the sulfur content of the desulfurized product stream is less than about 8 ppmw; and most preferably less than 5 ppmw.

The RON of the desulfurized product stream will be in the range of from about 95 to about 110; preferably in the range of from about 95 to about 105; and most preferably from 100 to 105.

Referring to FIG. 1, a cracked gasoline feedstock enters a reactor 100, which defines an aromatization reaction zone, via conduit 102, and contacts a catalyst composition comprising a zeolite contained within the aromatization reaction zone. The cracked gasoline feedstock is converted to an intermediate product stream. The intermediate product stream and a hydrogen stream are then charged to a hydrodesulfurization reactor 104, which defines a hydrodesulfurization reaction zone, via conduits 106 and 108, respectively, and contact a hydrodesulfurization catalyst composition contained within the hydrodesulfurization reaction zone. The intermediate product stream is desulfurized producing a desulfurized product stream which is removed from the hydrodesulfurization reactor 104 via conduit 110.

Figure 2:
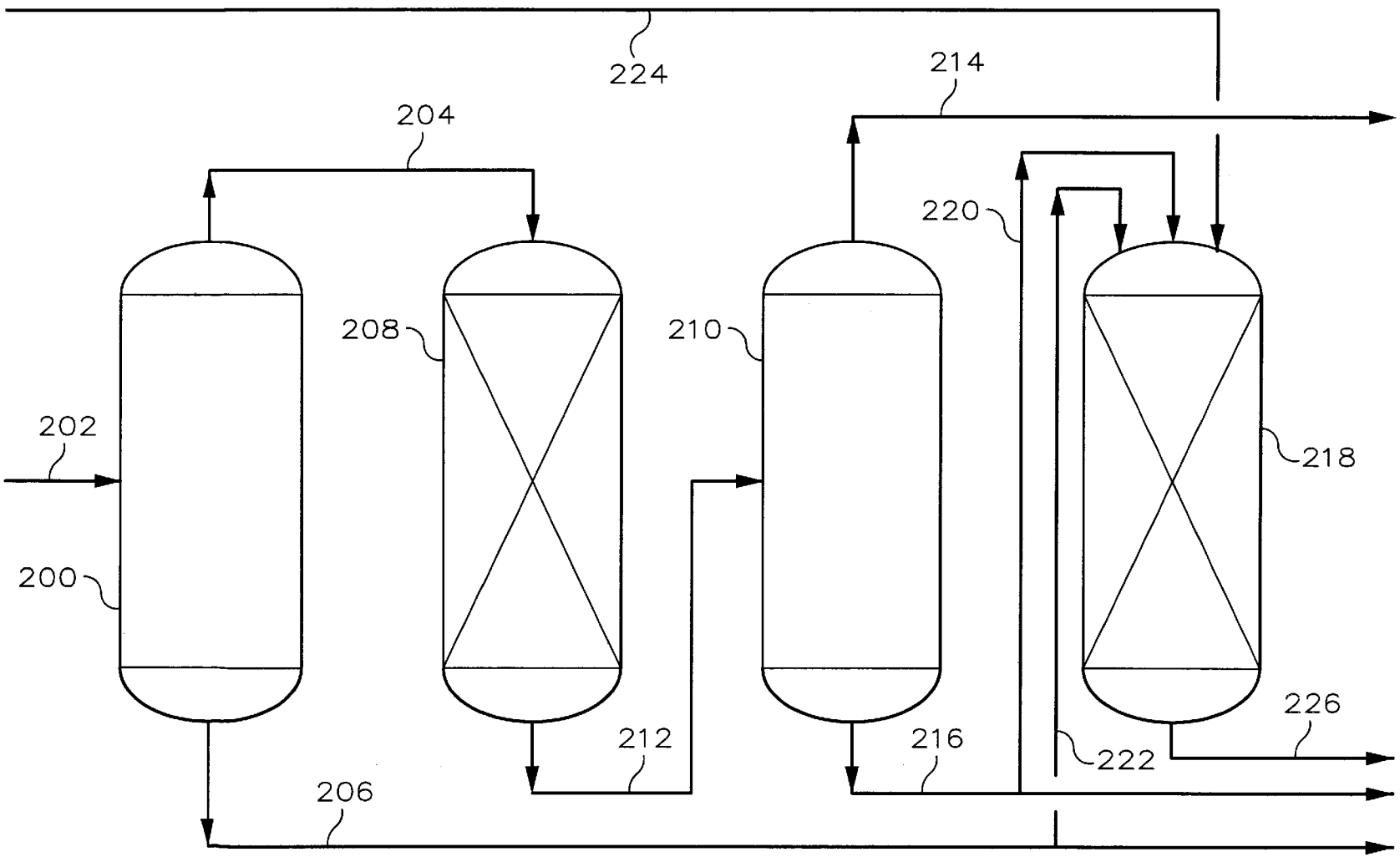
FIG. 2 is a schematic flow diagram presenting another embodiment of the present invention.

Referring now to FIG. 2, in another embodiment of the invention, a cracked gasoline feedstock enters a first separator 200, which defines a first separation zone, via conduit 202, and is separated into a light fraction and a heavy fraction. The light fraction is removed from the first separator 200 via conduit 204 and the heavy fraction is removed from the first separator 200 via conduit 206. The light fraction is then charged to a reactor 208, which defines an aromatization reaction zone, and contacts a catalyst composition comprising zeolite contained within the aromatization reaction zone. The light fraction is converted to an intermediate product stream. The intermediate product stream is then charged to a second separator 210, which defines a second separation zone, via conduit 212, and is separated into an overhead stream and a bottoms stream.

The overhead stream passes from second separator 210 via conduit 214 for further downstream gas processing. The bottoms stream passes from second separator 210 via conduit 216. At least a portion of the bottoms stream, at least a portion of the heavy fraction, and a hydrogen stream are then charged to a hydrodesulfurization reactor 218, via conduits 220, 222 and 224, respectively, and contact a hydrodesulfurization catalyst composition contained within the hydrodesulfurization reaction zone producing a desulfurized product stream. The remaining portion of the heavy fraction passes downstream for further processing through conduit 206 and the remaining portion of the bottoms stream passes downstream for further processing through conduit 216.

The desulfurized product stream is removed from the hydrodesulfurization reactor 218 via conduit 226.

Figure 3:
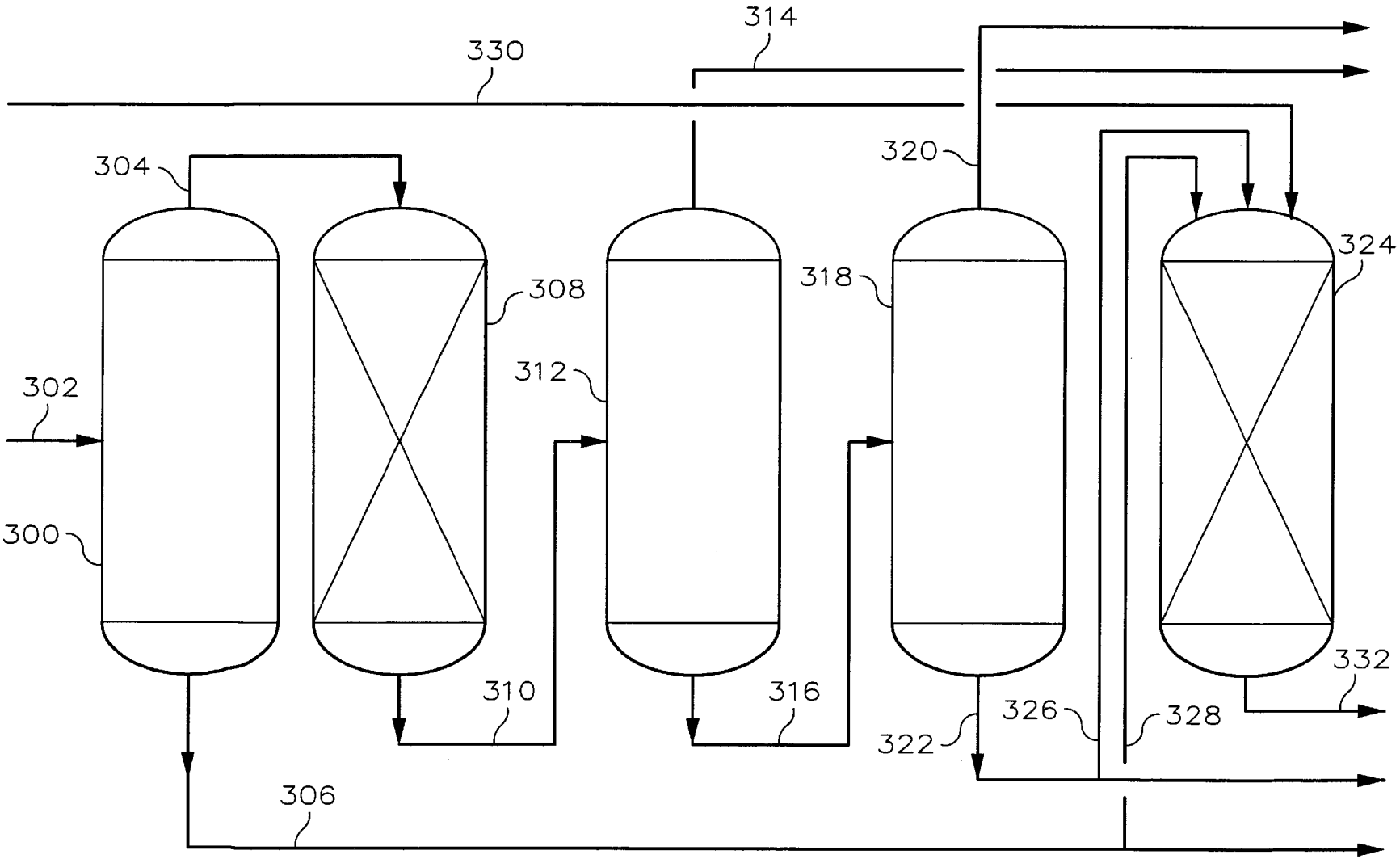
FIG. 3 is a schematic flow diagram presenting yet another embodiment of the present invention.

Referring now to FIG. 3, and yet another embodiment of the invention, a cracked gasoline feedstock enters a first separator 300, which defines a first separation zone, via conduit 302, and is separated into a light fraction and a heavy fraction. The light fraction and the heavy fraction are removed from first separator 300 via conduits 304 and 306, respectively. The light fraction is then charged to a reactor 308, which defines an aromatization reaction zone, and contacts a catalyst composition comprising zeolite contained within the aromatization reaction zone. The light fraction is converted to an intermediate product stream which is removed from reactor 308 via conduit 310.

The intermediate product stream is then charged to a second separator 312 and is separated into an overhead stream and a bottoms stream. The overhead stream is removed from the second separator 312 via conduit 314 for further downstream gas processing and the bottoms stream is removed from second separator 312 via conduit 316. The bottoms stream is then charged to a third separator 318, which defines a third separation zone, and is separated into a $C_8^-$ stream and a $C_9^+$ stream. The $C_8^-$ stream is removed from third separator 318 via conduit 320 for further downstream processing and the $C_9^+$ stream is removed from the third separator 318 via conduit 322. At least a portion of the $C_9^+$ stream, at least a portion of the heavy fraction, and a hydrogen stream are all charged to a hydrodesulfurization reactor 324, which defines a hydrodesulfurization reaction zone, via conduits 326, 328, and 330, respectively, and contact a hydrodesulfurization catalyst composition contained within the hydrodesulfurization reaction zone producing a desulfurized product stream. The remaining portion of the heavy fraction passes downstream for further processing through conduit 306 and the remaining portion of the $C_9$+ stream passes downstream for further processing through conduit 322. The desulfurized product stream is removed from the hydrodesulfurization reactor 324 via conduit 332.

The following example is provided to further illustrate this invention and is not to be considered as unduly limiting the scope of this invention.

EXAMPLE

This example illustrates the benefit of increased RON resulting from a desulfurization process including the steps of first aromatizing a cracked gasoline and, second, hydrodesulfurizing the resulting intermediate product stream.

The catalyst used for aromatizing was prepared by physically mixing a 14 gram sample of a commercially available ZSM-5 catalyst provided by Chemie Uetikon under product designation "PZ2/50H" (Zeocat) with 15 grams of a colloidal silica binder solution manufactured by Dupont under product designation Ludox®AS-40 and 1.4 grams of zinc hexaborate. The formed mixture was then extruded and dried at room temperature followed by steaming at 650° C. for 4 hours.

A 5 gram sample of the above described catalyst composition was placed into a stainless steel tube reactor with a length of about 20 inches and an inside diameter of about 0.5 inch. Cracked gasoline from a catalytic cracking unit of a refinery was passed through the reactor at a flow rate of about 14 ml/hour, at a temperature of about 600° C. and a pressure of about 25 psia for aromatization. The formed intermediate product stream exited the reactor tube and passed through several ice-cooled traps. Liquid and gaseous product samples were analyzed by means of a gas chromatograph. Results of the analysis of the intermediate product stream after 6 hours on stream are summarized in Table 2.

Engineering calculations were then performed to estimate the effect of hydrodesulfurization, using a typical cobalt/molybdenum HDS catalyst, on the intermediate product stream. Results of these calculations are also summarized in Table 2.

TABLE 2

| Component | Cracked Gasoline Feedstock | Intermediate Product Stream | Desulfurized Product Stream (calculated) |
|---|---|---|---|
| Sulfur ppmw | 200–300 | 150–250 | 1–10 |
| Paraffins, wt. % | 4.7 | 3.5 | 4.5 |
| I-Paraffins, wt. % | 30.8 | 15.4 | 20.1 |
| Aromatics, wt. % | 27.3 | 67.7 | 67.7 |
| Naphthenes, wt. % | 8.3 | 4.7 | 4.7 |
| Olefins wt. % | 27.4 | 5.7 | 0 |
| Unknowns wt. % | 1.5 | 3.0 | 3.0 |
| Total | 100 | 100 | 100 |
| RON | 89 | 105 | 100–105 |

As presented in Table 2, the inventive process desulfurizes a cracked gasoline feedstock and significantly increases the RON of the resulting desulfurized product stream.

Reasonable variations, modifications, and adaptations can be made within the scope of the disclosure and the appended claims without departing from the scope of this invention.

That which is claimed is:

1. A process for desulfurizing a cracked gasoline feedstock comprising at least about 20 ppmw sulfur, said process comprising:

separating said cracked gasoline feedstock into a light fraction comprising at least one hydrocarbon having less than 8 carbon atoms per molecule and a heavy fraction comprising at least one hydrocarbon having more than 7 carbon atoms per molecule;

contacting said light fraction with a catalyst composition comprising a zeolite, under reaction conditions for aromatizing hydrocarbons, to produce an intermediate product stream such that the combined total octane of said heavy fraction and said intermediate product stream exceeds the total octane of said cracked gasoline feedstock;

separating said intermediate product stream into an overhead stream comprising a light olefin and a bottoms stream comprising an aromatic; and contacting at least a portion of said bottoms stream and at least a portion of said heavy fraction with a hydrodesulfurization catalyst composition, under reaction conditions for desulfurizing sulfur containing hydrocarbons, to produce a desulfurized product stream having less than about 10 ppmw sulfur such that the combined total octane of the remaining portion of said bottoms stream, the remaining portion of said heavy fraction, the overhead stream, and the desulfurized product stream is at least the same as the total octane of said cracked gasoline feedstock.

2. A process as recited in claim 1 wherein said zeolite is ZSM-5.

3. A process as recited in claim 2 wherein said catalyst composition further comprises a promoter selected from the group consisting of zinc and boron, and mixtures thereof.

4. A process as recited in claim 3 wherein said promoter is zinc hexaborate.

5. A process as recited in claim 4 wherein the aromatization is carried out at a temperature in the range of from about 400° C. to about 800° C., a pressure in the range of from about 0 psia to about 500 psia and a weight hourly space velocity in the range of from about 0.01 $hr.^{-1}$ to about 1000 $hr.^{-1}$.

6. A process as recited in claim 5 wherein said hydrodesulfurization catalyst composition comprises a metal selected from the group consisting of molybdenum, tungsten, iron, cobalt, nickel; and mixtures thereof.

7. A process as recited in claim 6 wherein the hydrodesulfurization is carried out at a temperature in the range of from about 250° C. to about 1000° C., a pressure in the range of from about 0 psia to about 1000 psia, a weight hourly space velocity in the range of from about 0.01 $hr.^{-1}$ to about 1000 $hr.^{-1}$, and a hydrogen to hydrocarbon ratio of about 10 to about 5000 standard cubic feet of hydrogen per barrel of the combination of said at least a portion of said bottoms stream and said at least a portion of said heavy fraction.

8. A process as recited in claim 7 wherein the research octane number of said cracked gasoline feedstock is in the range of from about 80 to about 94, and wherein the research octane number of said desulfurized product stream is in the range of from about 95 to about 110.

9. A process for desulfurizing a cracked gasoline feedstock comprising at least about 20 ppmw sulfur, said process comprising:

separating said cracked gasoline feedstock into a light fraction comprising at least one hydrocarbon having less than 8 carbon atoms per molecule and a heavy fraction comprising at least one hydrocarbon having more than 7 carbon atoms per molecule;

contacting said light fraction with a catalyst composition comprising a zeolite, under reaction conditions for aromatizing hydrocarbons, to produce an intermediate product stream such that the combined total octane of said heavy fraction and said intermediate product stream exceeds the total octane of said cracked gasoline feedstock;

separating said intermediate product stream into an overhead stream comprising a light olefin and a bottoms stream comprising an aromatic;

separating said bottoms stream into a $C_8^-$ stream and a $C_9$+ stream, said $C_8^-$ stream comprising benzene, toluene and xylene; and contacting at least a portion of said $C_9$+ stream and at least a portion of said heavy fraction with a hydrodesulfurization catalyst composition, under reaction conditions for desulfurizing sulfur containing hydrocarbons, to produce a desulfurized product stream having less than about 10 ppmw sulfur such that the combined total octane of the remaining portion of said heavy fraction, the remaining portion of said $C_9$+ stream, said overhead stream, said $C_8^-$ stream, and said desulfurized product stream is at least the same as the total octane of said cracked gasoline feedstock.

10. A process as recited in claim 9 wherein said zeolite is ZSM-5.

11. A process as recited in claim 10 wherein said catalyst composition further comprises a promoter selected from the group consisting of zinc and boron, and mixtures thereof.

12. A process as recited in claim 11 wherein said promoter is zinc hexaborate.

13. A process as recited in claim 12 wherein the aromatization is carried out at a temperature in the range of from about 400° C. to about 800° C., a pressure in the range of from about 0 psia to about 500 psia and a weight hourly space velocity in the range of from about 0.01 $hr.^{-1}$ to about 1000 $hr.^{-1}$.

14. A process as recited in claim 13 wherein said hydrodesulfurization catalyst composition comprises a metal selected from the group consisting of molybdenum, tungsten, iron, cobalt, nickel, and mixtures thereof.

15. A process as recited in claim 14 wherein the hydrodesulfurization is carried out at a temperature in the range of from about 250° C. to about 1000° C., a pressure in the range of from about 0 psia to about 1000 psia, a weight hourly space velocity in the range of from about 0.01 $hr.^{-1}$ to about 1000 $hr.^{-1}$, and a hydrogen to hydrocarbon ratio of about 10 to about 5000 standard cubic feet of hydrogen per barrel of the combination of said at least a portion of said $C_9$+ stream and said at least a portion of said heavy fraction.

16. A process as recited in claim 15 wherein the research octane number of said cracked gasoline feedstock is in the range of from about 80 to about 94, and wherein the research octane number of said desulfurized product stream is in the range of from about 95 to about 110.

* * * * *